US005776392A

United States Patent [19]

Schmuck

[11] Patent Number: 5,776,392

[45] Date of Patent: Jul. 7, 1998

[54] METHOD FOR PRODUCING INSULATING PANELS BASED ON MINERAL AND PAPER FIBERS

[75] Inventor: Manfred Schmuck, Essen, Germany

[73] Assignee: Th. Goldschmidt AG, Essen, Germany

[21] Appl. No.: 818,816

[22] Filed: Mar. 14, 1997

[30] Foreign Application Priority Data

Mar. 15, 1996 [DE] Germany ..... 196 10 234.0

[51] Int. Cl.[6] ..... B28B 1/26

[52] U.S. Cl. ..... 264/86; 264/87

[58] Field of Search ..... 264/86, 87

[56] References Cited

U.S. PATENT DOCUMENTS

| | | | |
|---|---|---|---|
| 4,609,750 | 9/1986 | Kollmeier | 556/419 |
| 4,735,756 | 4/1988 | Rausch | 264/86 |
| 4,737,326 | 4/1988 | Wirth | 264/86 |
| 4,891,166 | 1/1990 | Schaefer | 260/404.5 |
| 5,246,607 | 9/1993 | Schaefer | 252/389.32 |

FOREIGN PATENT DOCUMENTS

| | | |
|---|---|---|
| 3422268 | 7/1985 | Germany . |
| 3719086 | 10/1988 | Germany . |
| 3837811 | 4/1990 | Germany . |

*Primary Examiner*—James Derrington
*Attorney, Agent, or Firm*—Anderson, Kill & Olick, P.C.

[57] ABSTRACT

A method for producing insulating panels based on mineral fibers and paper fibers is disclosed. The panels are formed by preparing a suspension of mineral fibers, binders and conventional additives in water, forming the insulating panel by applying the slurry on a screen, drying and consolidating the insulating panel. Due to the use of surface active siloxanes, which contain betaine or quaternary groups, a more rapid and better dewatering of the filter residues, which are intended for the drying process, is attained.

5 Claims, No Drawings

METHOD FOR PRODUCING INSULATING PANELS BASED ON MINERAL AND PAPER FIBERS

FIELD OF INVENTION

The invention relates to a method for producing insulating panels based on mineral fibers and paper fibers by preparing a suspension or slurry of mineral fibers, binders and conventional additives in water, forming the insulating panel by applying the slurry on a screen, drying and consolidating the insulating panel.

BACKGROUND INFORMATION AND PRIOR ART

Such panels, provided with decorative surfaces, are used in suspended ceilings or wall panels predominantly for the acoustic insulation of rooms. They are, however, also used for structural fire protection, particularly as door fillings and linings of girders and posts in steel constructions as well as of ventilation and electrical lead ducts.

Said panels are produced by a so-called wet method. A highly aqueous suspension of preferably slag or mineral wool, paper fibers, starch, clay and kaolin is prepared. A portion of the water is removed from this suspension by filtration with suction through a screen. The filter cake, so formed, is then taken to an oven, in which the residual water is evaporated at an drying and a firm bond is formed between mutually crossing slag wool fibers and paper fibers.

In order to achieve faster dewatering on the machine screen, nonionic surfactants are added to the aqueous suspension (also in order to reduce the specific gravity due to the resulting foam). This addition of surfactant has, however, the disadvantage that, after the drying, a highly hydrophilic component remains in the panels. These disadvantages are shown in detail in the following.

After the dried raw plates have been ground, they are coated with aqueous dispersions pains. Since the substrate is highly porous and therefore much paint migrates into the substrate, unnecessary paint is consumed by this process.

Moreover, the previously used surfactants tend to absorb moisture from the air. As a result, the binder used may soften and consequently the bonding force may be reduced, so that the panels, fastened in the frame, may sag under their own weight.

OBJECT OF THE INVENTION

It is an object of the invention to withdraw as much water as possible from the mixture before the drying process and to ensure that no hydrophilic surfactant (such as alkylphenyl ethoxylate) remains in the panel.

SUMMARY OF THE INVENTION

Pursuant to the invention, this objective is accomplished through the use of surfactant siloxanes, which are listed in the following and have betaine or quaternary groups.

Preferably, betaines are used, which have the general formula

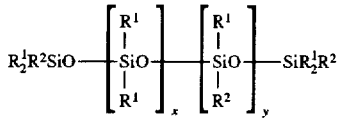

wherein $R^1$ are the same or different in the molecule and represent an alkyl group with 1 to 18 carbon atoms, a phenyl group or a polyoxyalkylene group, with the proviso that at least 70% of the $R^1$ groups are methyl groups.

$R^2$ may be the same as $R^1$, with the proviso that at least one $R^2$ group is the

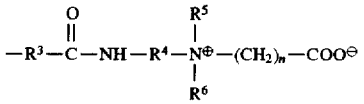

group, in which $R^3$ is a divalent alkylene group with 2 to 12 carbon atoms, $R^4$ is a divalent alkylene group with 2 to 6 carbon atoms, $R^5$, $R^6$ are the same or different and represent an alkyl group with 1 to 4 carbon atoms or a benzyl group, n is 1, 2 or 3, x has a value of 0 to 200 and y has a value of 1 to 50.

Examples of these organopolysiloxanes with betaine groups, which are used pursuant to the invention, are:

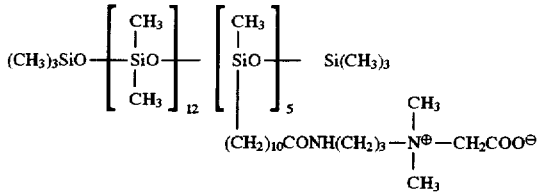

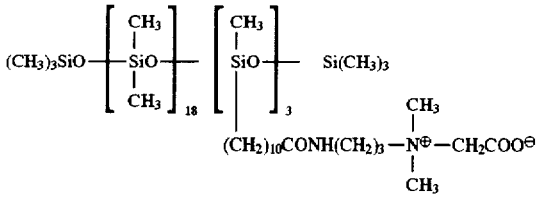

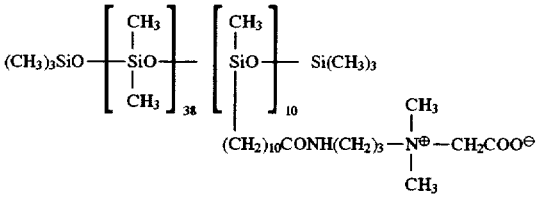

-continued

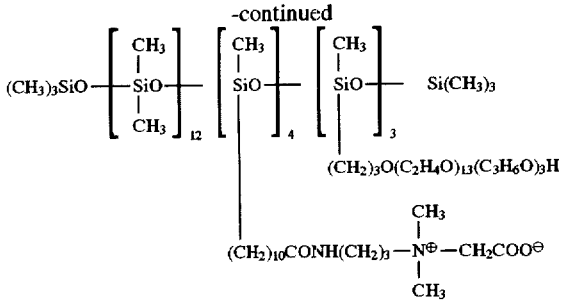

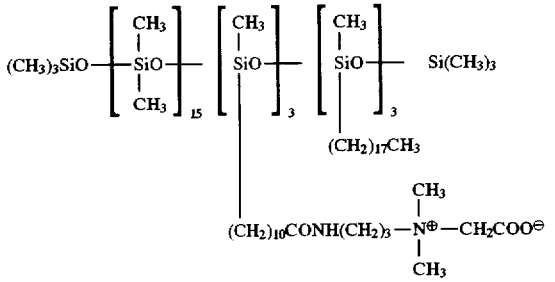

A further distinguishing feature of the invention is the use of polysiloxanes with quaternary ammonium groups of the general formula

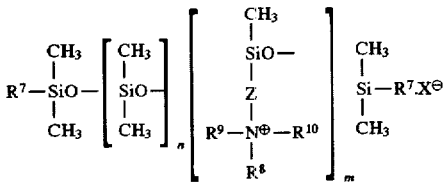

wherein $R^7$ are the same or different in the molecule and represent a methyl group or the

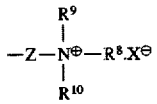

group, $R^8$ are the same or different in the molecule and represent an alkyl group with 1 to 18 carbon atoms or the $R^{11}$—CONH—$(CH_2)_4$— group, in which $R^{11}$ is an alkyl group with 7 to 17 carbon atoms, $R^9$, $R^{10}$ are the same or different in the molecule and represent an alkyl group with 1 to 4 carbon atoms, z is the

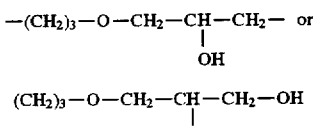

group $x^{\ominus}$ is an inorganic or organic anion, which is derived from a physiologically tolerated acid HX, n has a value of 5 to 20, m has a value of 1 to 10, the ratio of the number of dimethylsiloxy groups to the number of quaternary ammonium groups having a value of 0.5 to 15.

Examples of particularly suitable compounds are

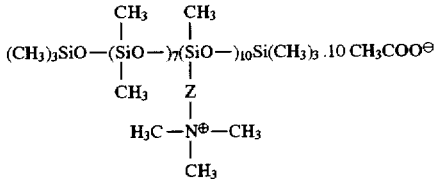

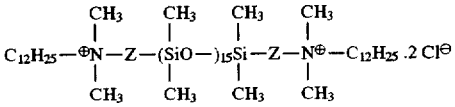

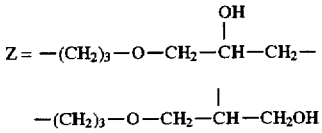

As usable compounds, polysiloxanes with quaternary groups, which have the following formula

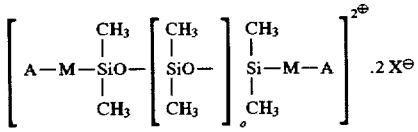

can be used equally well. In the above formula,

A represents the

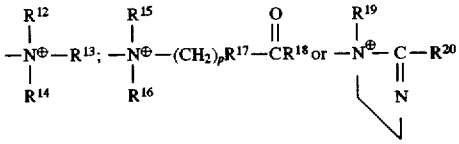

group $R^{12}$, $R^{13}$, $R^{14}$ are alkyl groups with 1 to 22 carbon atoms or alkenyl groups with 2 to 22 carbon atoms, it being possible for the alkyl or alkenyl groups to have hydroxyl groups and at least one of the —$R^{12}$—, $R^{13}$, $R^{14}$ groups having at least 10 carbon atoms, $R^{15}$, $R^{16}$, $R^{18}$, $R^{19}$, $R^{20}$ are alkyl groups with 1 to 22 carbon atoms or alkenyl groups with 2 to 22 carbon atoms, it being possible for the alkyl or alkenyl groups to have hydroxyl groups, $R^{17}$ is an —O— or an —$NR^{21}$— group, $R^{21}$ is an alkyl or hydroxyalkyl group with 1 to 4 carbon atoms or a hydrogen atom, p is 2 to 4, M is a divalent group, selected from the group

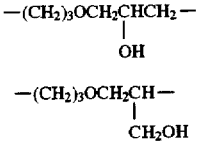

-continued

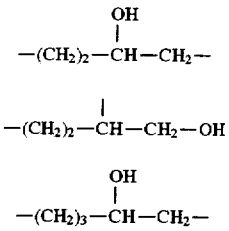

-continued

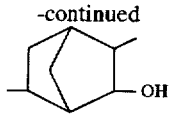

the nitrogen atom of the A group being linked to the M group over the carbon atom adjacent to the C-OH group in the M group, 0 is a number from 0 to 200 and $X^{\ominus}$ has the meaning given above.

Examples of these particularly suitable quaternary siloxanes are

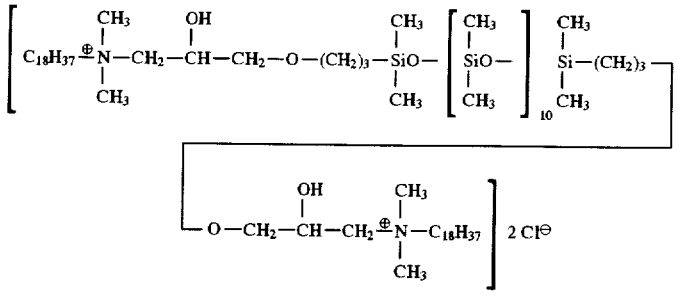

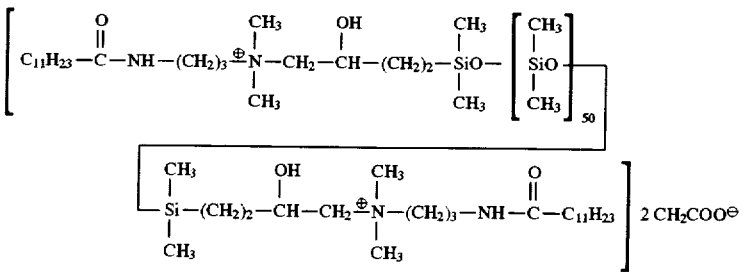

-continued

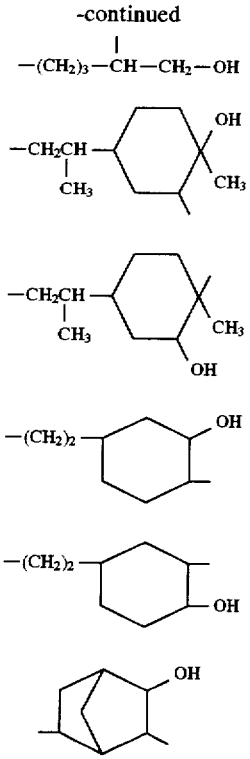

The synthesis of the above-mentioned siloxanes, which have betaine or quaternary groups, is described, for instance, in the DE-C-34 22 268, DE-C-37 19 086 and DE-C-38 37 811.

The use of these siloxanes has been observed to result in exceptionally rapid dewatering. Consequently, the filter residues, which are intended for the drying process, contain clearly less water. Energy is thus saved and higher production rates are attained. The dried panels clearly exhibit hydrophobic properties on their surface.

It has proven to be advantageous to add silicone resins as hydrophobizing agent to the mineral fiber and paper fiber suspension. Through the use of these known silicone resins in conjunction with the surfactant siloxanes, used pursuant to the invention, an even more uniform and better hydrophobization is achieved.

Usually, silicone resins having the general formula

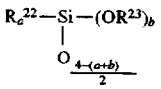

wherein $R^{22}$ is an alkyl group with 1 to 8 carbon atoms or a phenyl group;

$R^{23}$ is an alkyl group with 1 to 4 carbon atoms;

a is 0.8 to 1.2; and b is 0.2 to 1.2, is added to the slurry in amounts of 0.02 to 2% by weight, based on the solids content.

The inventive method is described in even greater detail by means of the following examples.

To begin with, a mixture is prepared, to which no surfactant is added.

Rock wool (120 g), 10 g of starch, 30 g of clay and 0.4% by weight, based on the solids above, of a 50% hydrophobizing emulsion, based on methylsilicone resin, are added to 3 L of water and mixed well.

EXAMPLE 1

(not of the invention)

To the standard mixture described above, 0.1% by weight of a surfactant of the state of the art, namely, a nonylphenol ethoxylate with 6 ethylene oxide groups is added.

EXAMPLE 2

(of the invention)

To the standard mixture, 0.1% by weight of a siloxane with quaternary groups of the following composition is added

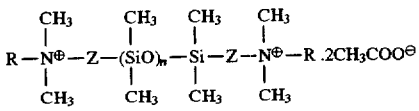

$$R-N^{\oplus}(CH_3)_2-Z-(SiO)_n-Si(CH_3)_2-Z-N^{\oplus}(CH_3)_2-R\ .2CH_3COO^{\ominus}$$

$$Z = -CH_2-CH(OH)-CH_2-O-(CH_2)_3-$$

$$R = \text{long-chain alkyl group } C_{12}H_{25}-$$

EXAMPLE 3

(of the invention)

To the standard mixture, 0.1% by weight of a siloxane having betaine groups and the following formula:

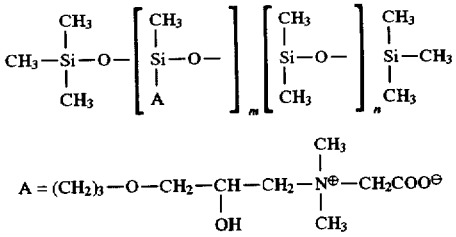

$$CH_3-Si(CH_3)_2-O-\left[Si(CH_3)(A)-O\right]_m\left[Si(CH_3)_2-O\right]_n Si(CH_3)_2-CH_3$$

$$A = (CH_2)_3-O-CH_2-CH(OH)-CH_2-N^{\oplus}(CH_3)_2-CH_2COO^{\ominus}$$

is added. The surfactant concentrations used are related to the solids content of the standard mixture.

This suspension is added successively to a suction filter with a black-band filter on a suction flask and filtered under a vacuum of 50 mbar produced with a water-jet pump.

The filtering process requires 27 minutes for the standard mixture 22 minutes for the mixture of the state of the art (Example 1)

11 and 10 minutes for the mixture with the siloxane added pursuant to the invention (Examples 2 and 3).

Correspondingly, the water contents of the residues on filter, are as follows:

standard mixture 61%

Example 1 56%

Example 2 46%

Example 3 45%

EXAMPLE 4

The considerably improved hydrophobic properties of a mineral fiber ceiling panel, which was treated with the siloxane surfactants used pursuant to the invention, are shown in this example by means of the water-absorption values.

The panel-shaped filter residues of Examples 1, 2 and 3 are dried in each case for 1 ¾ hours at 170° C., allowed to cool, weighed and subsequently immersed in water in a water bath, 5 cm deep, for a period of 2 hours. After that, the samples listed above are removed, the surface water is blotted off with filter paper and the samples are weighed once again. The following water-absorption values are obtained:

Example 1 18%

Example 2 7%

Example 3 8%

The water-absorption values clearly show that panels with hydrophobic properties can be produced through the use of the inventive surfactants.

On the one hand, the samples, for which the inventive siloxanes were used, were dewatered appreciably more rapidly than the standard mixture and the sample with the alkylaryl sulfonate (nonylphenol ethoxylate with 6 ethylene oxide groups), on the other, these samples contain clearly less water. This means that, aside from lower energy costs, higher production speeds can also be attained for the manufacture mineral fiber and paper fiber panels. In addition, the finished panels show clearly improved hydrophobic properties.

I claim:

1. In a method for producing insulating panels of mineral fibers and paper fibers wherein a slurry of mineral fibers and paper fibers, binders and additives selected from the group consisting of aluminum hydroxide, magnesium hydroxide, clay and kaolin, is prepared in water, the insulating panel is formed by applying the slurry on a screen and drying and consolidating the insulating panel, the improvement wherein a siloxane containing betaine or quaternary groups is added to the slurry in amounts of 0.01 to 3% by weight, based on the solids content of the slurry.

2. The improvement of claim 1, wherein the siloxane has the general formula

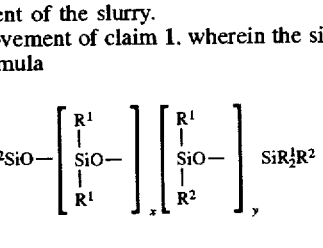

$$R^1_2R^2SiO-\left[SiO(R^1)_2\right]_x\left[SiO(R^1)(R^2)\right]_y SiR^1_2R^2$$

containing betaines groups, are used, wherein $R^1$ are the same or different in the molecule and represent an alkyl group with 1 to 18 carbon atoms, a phenyl group or a polyoxyalkylene group, with the proviso that at least 70% of the $R^1$ groups are methyl groups, $R^2$ may be the same as $R^1$, with the proviso that at least one $R^2$ group is the

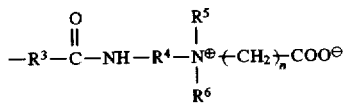

$$-R^3-C(=O)-NH-R^4-N^{\oplus}(R^5)(R^6)-(CH_2)_n-COO^{\ominus}$$

group, in which $R^3$ is a divalent alkylene group with 2 to 12 carbon atoms, $R^4$ is a divalent alkylene group with 2 to 6 carbon atoms, $R^5$, $R^6$ are the same or different and represent an alkyl group with 1 to 4 carbon atoms or a benzyl group, n is 1, 2 or 3, x has a value of 0 to 200 and y has a value of 1 to 50.

3. The improvement of claim 1, wherein the siloxanes containing quaternary ammonium groups has the general formula

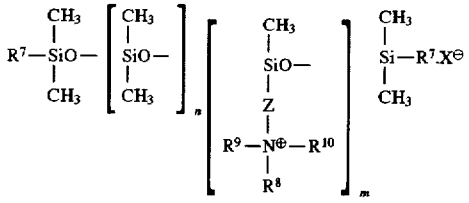

wherein $R^7$ are the same or different in the molecule and represent a methyl group or the

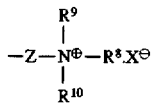

group, $R^8$ are the same or different in the molecule and represent an alkyl group with 1 to 18 carbon atoms or the $R^{11}$—CONH—$(CH_2)_{3-4}$— group, in which $R^{11}$ is an alkyl group with 7 to 17 carbon atoms, $R^9$, $R^{10}$ are the same or different in the molecule and represent an alkyl group with 1 to 4 carbon atoms, Z is the

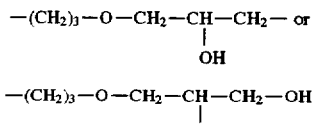

group $X^{\ominus}$ is an inorganic or organic anion, which is derived from a physiologically tolerated acid HX, n has a value of 5 to 20, m has a value of 1 to 10, the ratio of the number of dimethylsiloxy groups to the number of quaternary ammonium groups having a value of 0.5 to 15.

4. The improvement of claim 1, wherein apolysiloxane containing quaternary groups is used which has the general formula

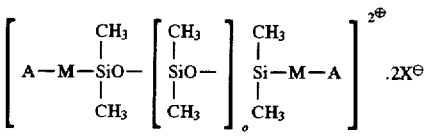

wherein A represents the

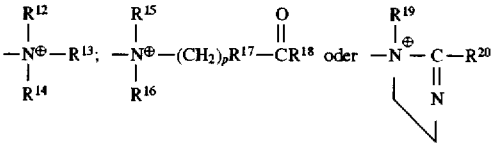

group, wherein, $R^{12}$, $R^{13}$, $R^{14}$ are alkyl groups with 1 to 22 carbon atoms or alkenyl groups with 2 to 22 carbon atoms, the alkyl or alkenyl groups optionally having hydroxyl groups and at least one of the $R^{12}$, $R^{13}$, $R^{14}$ groups having at least 10 carbon atoms, $R^{15}$, $R^{16}$, $R^{18}$, $R^{19}$, $R^{20}$ are alkyl groups with 1 to 22 carbon atoms or alkenyl groups with 2 to 22 carbon atoms, the alkyl or alkenyl groups optionally having hydroxyl groups, $R^{17}$ is an —O— or an —$NR^{21}$— group, $R^{21}$ is an alkyl or hydroxyalkyl group with 1 to 4 carbon atoms or hydrogen atom, is 2 to 4, M is a divalent group, selected from the group consisting of

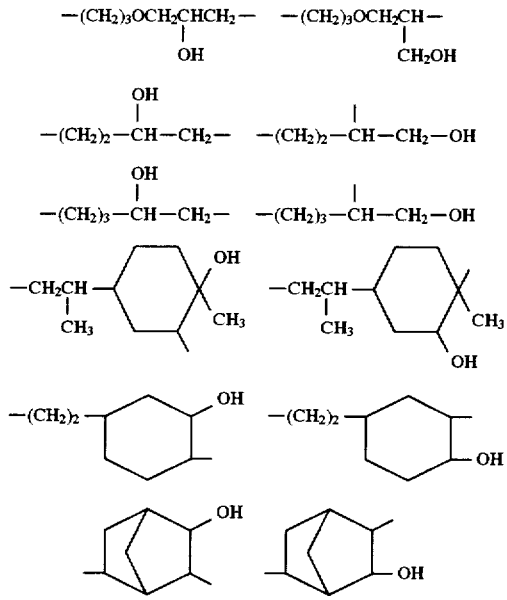

the nitrogen atom of the A group being linked to the M group over the carbon atom adjacent to the C-OH group in the M group, 0 is a number from 0 to 200, and $X^{\ominus}$ is an inorganic or organic anion, which is derived from a physiologically tolerated acid HX.

5. The improvement of claim 1, wherein, in addition to the siloxane, silicone resins are added to the suspension or slurry in amounts of 0.02 to 2% by weight, based on the solids content, and wherein the silicone resins have the general formula $$R_a^{22}-\underset{\underset{O_{\frac{4-(a+b)}{2}}}{|}}{Si}-(OR^{23})_b$$

wherein $R^{22}$ is an alkyl group with 1 to 8 carbon atoms or a phenyl group;

$R^{23}$ is an alkyl group with 1 to 4 carbon atoms;

a is 0.8 to 1.2; and b is 0.2 to 1.2.

* * * * *